United States Patent [19]

Law

[11] 4,004,733

[45] Jan. 25, 1977

[54] ELECTROSTATIC SPRAY NOZZLE SYSTEM

[75] Inventor: S. Edward Law, Athens, Ga.

[73] Assignee: Research Corporation, New York, N.Y.

[22] Filed: July 9, 1975

[21] Appl. No.: 594,266

[52] U.S. Cl. ..... 239/3; 239/15; 239/106; 239/290; 239/424; 329/DIG. 7

[51] Int. Cl.[2] ..... B05B 5/02; B05B 7/06

[58] Field of Search ..... 239/3, 15, DIG. 7, 398, 239/311, 424, 290, 291, 106

[56] References Cited

UNITED STATES PATENTS

| | | | |
|---|---|---|---|
| 1,650,686 | 11/1927 | Binks | 239/290 X |
| 2,214,035 | 9/1940 | Tracy | 239/290 X |
| 2,302,289 | 11/1942 | Bramston-Cook | 239/3 |
| 3,212,211 | 10/1965 | Bennett | 239/3 X |
| 3,317,138 | 5/1967 | Fraser | 239/15 |
| 3,539,103 | 11/1970 | Marsh | 239/15 |
| 3,630,441 | 12/1971 | Felici et al. | 239/3 X |
| 3,653,593 | 4/1972 | Watanabe | 239/15 |
| 3,698,635 | 10/1972 | Sickles | 239/3 |
| 3,717,306 | 2/1973 | Hushon et al. | 239/424 X |
| 3,774,844 | 11/1973 | Walberg | 239/15 |

*Primary Examiner*—Robert S. Ward, Jr.
*Attorney, Agent, or Firm*—Cooper, Dunham, Clark, Griffin & Moran

[57] ABSTRACT

A system for electrostatic spraying of liquids, such as agricultural pesticides, paints and other liquids, which relies on a novel spray nozzle that combines pneumatic atomization and electrostatic induction charging to provide a stream of electrostatically charged fine droplets. The nozzle uses a low voltage power supply, e.g. a 12 volt battery, electronically raises the voltage to a level in the range of several hundred to several thousand volts, and applies the high voltage to an annular induction electrode which is embedded in the spray nozzle. The high voltage components are inside the nozzle, which is made of an electrically insulating material, to minimize the danger of shock and the possibility of mechanical damage to the high voltage components. The spray nozzle operates at a relatively low voltage and at a low input power, but provides a droplet stream at a high droplet charging level, for effective and uniform deposition of the sprayed liquid onto the target.

14 Claims, 4 Drawing Figures

ELECTROSTATIC SPRAY NOZZLE SYSTEM

BACKGROUND OF THE INVENTION

The invention is in the field of electrostatic spraying systems and relates specifically to a system using a novel electrostatic spraying nozzle.

Electrostatic coating includes processes which use electrostatic forces to bring about the deposition of a material, which may be dry or wet, over a surface to produce thereon a layer or coat. Coating processes are widely used, and it is highly desirable to apply the coating materials with the smallest possible loss and with the utmost simplicity. The use of electrostatic forces in the coating process achieves such desirable ends. In general, electrostatic coating involves forming the coating material into finely divided particles or droplets, charging the particles or droplets to one polarity (e.g. negative) and the surface to be coated to a different polarity (e.g. positive). Even at ground potential the coating target has induced into it from the "ground reservoir" a very appreciable net charge of sign opposite to the incoming charged cloud. As a result of electrostatic attraction and the proximity of the particles or droplets to the surface to be coated, electrostatic forces move the particles or droplets toward the surface, where they are deposited to form a coat or layer. Various prior art electrostatic coating applications are more sophisticated modifications of this simple situation. They differ from one another in the manner in which the particles are formed, the means by which they are charged, the particular aspects of the methods by which the particles are distributed about the surface and perhaps in the way in which they collect upon it. A review of prior art electrostatic process can be found in *Electrostatics and Its Applications*, Moore, *A.D.*, Ed., Wiley and Sons, 1973, particularly pages 250–280.

The use of electrostatic spraying or coating is generally limited to carefully controlled industrial environments, primarily because of the electrical hazard due to the high voltages that are typically used. There are, however, some uses where it is not possible or practical to carefully control the environment, for example, the use of electrostatics to spray agricultural particulates used for pest control, such as pesticides spray droplets, pesticide dusts, biological-control organisms, etc. One example of such system is discussed in Point, U.S. Pat. No. 3,339,840, and there have been other, commercially available electrostatic dusters for agricultural use. Such systems typically use high D.C. voltages in the range of 15–90 kilovolts and use exposed high-voltage electrostatic charging electrodes. For an example of an exposed electrode in an uncontrolled environment, see Buser et al., U.S. Pat. No. 3,802,625.

Thus, electrostatics are used primarily in carefully controlled industrial surroundings and are not sufficiently widely used elsewhere, such as in agriculture, where any improvement in coating efficiency would be very significant. For example, it is estimated that presently only about 20% of the spraying or dusting material reaches the target plants, and that the figure can be significantly raised by the use of electrostatic deposition. Since the present cost of the pesticide materials used for controlling insect and disease pests of the U.S. food and fiber crops is over $1.5 billion annually, it is clear that even only a two-fold improvement in the presently poor deposition efficiency would provide annual savings of well over $0.5 billion. Morever, the considerably lower amount of pesticide material that would be needed for electrostatic spraying would significantly reduce the danger to the environment. There exists, therefore, a great need for an electrostatic spraying system which can be used not only in carefully controlled industrial environments but also in less controlled environments, such as in agricultural spraying, i.e., a system which uses spray nozzles that operate at a relatively low voltage, do not present electrical hazard and are simple, reliable, rugged and inexpensive.

Summary of the Invention

The invention relates to electrostatic spraying systems and particularly to a system of this type using a novel electrostatic spray nozzle which operates at relatively low charging voltages, provides a stream of finely divided droplets at a high spray-cloud charge, and is safe, simple, rugged, and reliable.

The electrostatic spray nozzle used in the invented system forms a liquid stream into a stream of finely divided droplets, and charges these finely divided droplets by an electrode which is embedded in the electrically insulating nozzle and operates at a relatively low voltage (to thereby prevent electrical hazard) but at high efficiency to impart a high spray-cloud charge to the stream of liquid droplets. Moreover, the electrical capacitance of the electrode is very low, to further insure safe operation. The liquid stream which is formed into droplets can be any liquid material, i.e., a pure liquid, a solution, or a suspension of a wettable powder and other wettable particulates in atomized form in either a volatile or nonvolatile carrier liquid. The liquid typically remains at ground voltage and can be anywhere in the range between highly conductive and highly resistive liquids. The liquid is formed into finely divided droplets inside the nozzle by a mechanism such as pneumatic atomizing, and the droplets are charged at the moment of formation by electrostatic inductive charging by an induction electrode which surrounds the droplet forming region. The charging electrode, which can be an annular electrode, is kept dry by a gaseous (air) slipstream interposed between the inner surface of the annular electrode and the droplet forming region. The electrode is at a relatively low potential of several hundred to several thousand volts with respect to the remainder of the nozzle and the liquid, which are typically at ground, and is embedded in the nozzle (which is made of an electrically insulating material) so as not to present an electrical hazard and to be protected from mechanical damage in use. The high voltage to the electrode is provided by a miniature electronic circuit which is typically supplied from a low voltage source, such as a 12 volt battery, and is typically attached to or embedded in the nozzle to avoid any high voltage leads that may be susceptible to mechanical damage or can present an electrical hazard. The charging electrode can be at a negative or at a positive potential with respect to the liquid and the remainder of the nozzle.

In a specific embodiment of the invention, the electrostatic spray nozzle comprises a pneumatic-atomizing nozzle in which the kinetic energy of a high velocity airstream shears a liquid jet into droplets as the jet issues from an orifice properly placed with respect to the high velocity airstream. The droplet shearing process takes place at a droplet forming region which is inside the hollow passage of a housing made of an electrically insulating material. An annular electrode is disposed within the housing and surrounds the droplet forming region. Wetting of the electrode by droplets is prevented by an air slipstream which maintains a high shearing force at the inner face of the annular electrode. The electric field lines originating on the induction electrode are concentrated in the vicinity of, and terminate upon, the droplet forming region, and the gap between the electrode and the liquid stream is so small that the electric field gradient just off the droplet forming region is extremely intense even at relatively low potentials of the electrode with respect to the liquid, thus imparting a high spray droplet charge. The electrode is spaced inwardly from the front end of the housing, from which the droplet stream issues, to prevent electrical hazard and mechanical damage to the electrode. The high velocity slipstream of air maintains a high shearing force at the inner surface of the electrode, to keep it completely dry, and additionally maintains the high surface resistance of the insulating dielectric material along the internal surface of the passage through the housing, by maintaining this passage surface dry and free of droplets.

More specifically, one embodiment of the invented electrostatic spray nozzle comprises a base having an axially extending central conduit for receiving liquid under pressure at its back end and for issuing a forwardly directed liquid stream at its front end. The base further has a separate, forwardly extending conduit for receiving air under pressure at its back end and for issuing a forwardly directed airstream at its front end for atomizing the liquid stream. A housing is fixedly secured to the base and has a forwardly extending nozzle passage coaxial with the liquid conduit of the base. The nozzle passage through the housing has a back portion communicating with the air and liquid conduits of the base to receive the streams issuing from these conduits, and has a front portion spaced forwardly of the back portion. An annular electrode is disposed within the housing, coaxially with the nozzle passage, and has a front end which is rearwardly of the front portion of the nozzle passage through the housing but is forwardly of the front end of the air and liquid conduits. The base and the back portion of the nozzle passage through the housing define a region where the air and liquid streams interact and form a forwardly directed droplet stream starting at a droplet forming region which is rearwardly of the front end of the electrode. An air slipstream through the electrode and through at least part of the nozzle passage prevents deposition of droplets thereon. The housing is made of an electrically insulating material to prevent electrical hazard when the electrode is at a high potential with respect to ground.

The invented spray nozzle typically uses internal pneumatic atomization to form a liquid stream into a stream of finely divided droplets at a droplet forming region which is inside the nozzle. While pneumatic atomization is selected because it provides finely atomized droplets (typically with diameters of around 50 microns) which are of a size range where electrostatic forces predominate and of a size range which has been shown to offer distinct advantages in chemical pest control, other methods for droplet formation can be used. Whatever droplet forming means are used, it is important for this invention that the droplet forming region be inside the nozzle so that the droplets can be charged by an electrode that is embedded in the nozzle to prevent electrical hazard and mechanical damage.

The invented nozzle, with an embedded induction electrode, offers numerous advantages over comparable spray nozzles. Specifically, the invented nozzle is capable of incorporating an internal pneumatic-atomizing device which produces the smaller size droplets which are desirable for many uses and which can effectively utilize electrostatic forces. The invented nozzle can safely and satisfactorily charge both highly conductive and highly resistive liquid, where the liquid typically remains at ground potential. The nozzle can charge spray to either polarity equally well, and the induction charging process is accomplished at much lower voltages and currents than needed for equal spray-charging by other processes, such as by the ionized field process. For example, the proper design and placement of the induction electrode in the embodiment described in detail later in this specification permits the use of an electrode potential of only about two kilovolts to charge droplets to a charge equal to that attained at about 15–90 kilovolts in typical ionized field charging nozzles, and the invented nozzle uses in the process less than one-half watt of electrical input power. The charging voltage power supply is typically affixed to or embedded in the invented spray nozzle, to avoid any high voltage leads that may be hazardous and may be susceptible to mechanical damage, and the high-voltage power supply may be in turn supplied with a low voltage input from a source such as a 12 volt battery. Of course, in a more controlled environment, a number of nozzles can share the same high-voltage source by connection thereto through suitable high-voltage cable, possibly with some means for individually controlling the charging voltage of each nozzle. In general, the invented spray nozzle offers the advantages of low cost, portability, safety and simplicity, and is useful both in industrial surroundings and in less controlled environments, such as agricultural spraying and home uses.

DETAILED DESCRIPTION

Figure 1:
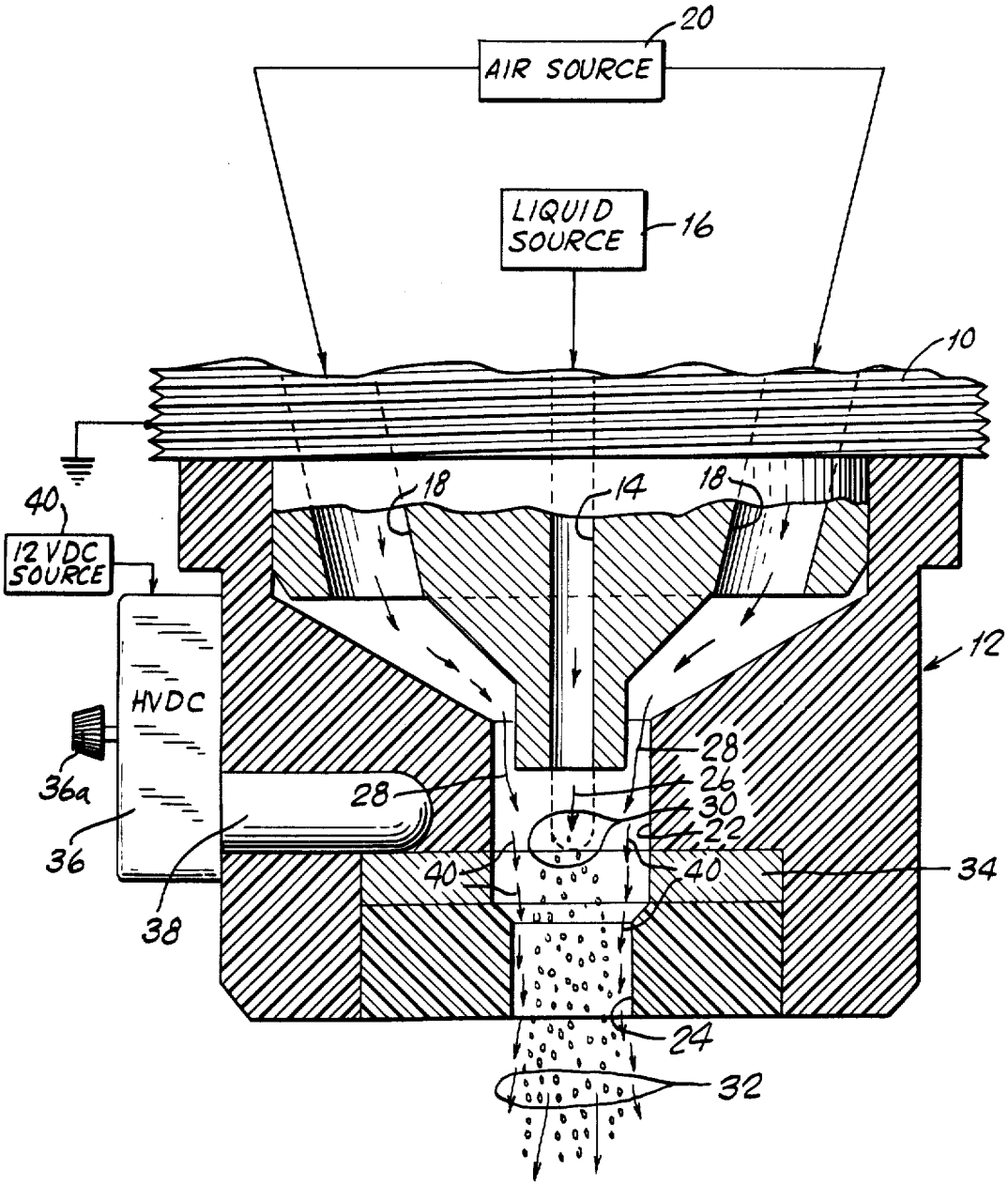
FIG. 1 is a partly sectional view and a partly block diagram of an electrostatic spray nozzle system embodying the invention.

Referring to FIG. 1, one embodiment of the invented electrostatic spray nozzle comprises a generally tubular body formed of a base 10 and a housing 12 arranged generally coaxially and affixed to each other. The base 10 has an axially extending, central conduit 14 receiving at its back end liquid under pressure from a liquid source schematically shown at 16. The base 10 further has a separate, forwardly converging conduit 18 receiving at its back end a gas, such as air, under pressure from a source schematically shown at 20. The air conduit 18 may be in the form of a number of separate passageways, converging forwardly toward the front end of the conduit 14, as is conventional in pneumatic-atomizing nozzles. The housing 12 has an axially extending nozzle passage which is coaxial with the liquid conduit 14 and comprises a tubular passage 22 and a coaxial, reduced diameter tubular passage 24 which terminates at a spray orifice at the front end of the housing 12. The back end of the passage 22 in the housing 12 communicates with the front ends of the liquid passage 14 and the air passage 18, to receive therefrom a liquid stream 26 and an air stream 28 respectively. The liquid stream 26 and the airstream 28 interact with each other at a droplet forming region 30 where the kinetic energy of the high velocity airstream 28 shears the liquid stream 26 into droplets and the remaining kinetic energy of the airstream 28 carries forward the resulting droplet stream 32 and additionally forms a slipstream 40. The droplets of the droplet stream 32 are finely atomized and are typically around 50 microns in diameter, although there may be substantial occasional deviations from that typical size. An annular induction electrode 34, made of an electrically conductive material such as brass or another metal, is embedded in the housing 12 and surrounds the passage 22 in the vicinity of the droplet forming region 30, such that the electric field lines due to a potential difference between the electrode 34 and the liquid stream 26 can terminate onto the liquid stream 26. The induction electrode 34 is maintained at a potential with respect to the liquid stream 26 of several hundred to several thousand volts by a high voltage source 36. The source 36 is affixed to the housing 12 and has a high voltage output connected to the electrode 34 through a high voltage lead 38 and a low voltage input connected to a low voltage source 40. The function of the high voltage source 36 is to convert the low voltage input to a selected high voltage output, e.g., to convert 12 volts D.C. from a source such as a vehicle battery to a high voltage output, which can be adjusted within the range of several hundred to several thousand volts D.C. High voltage sources of this type typically include an oscillator powered by the low voltage D.C. source and producing an A.C. output, a transformer converting the A.C. output of the oscillator to a high A.C. voltage, a rectifier converting the high voltage A.C. output of the transformer to a D.C. voltage and some adjustable means 36*a* to control the voltage level at the A.C. output. Since the particular circuit used in the high voltage source 36 is not novel, and since sources of this type are available in the prior art, no further description should be needed.

The base 10 is made of an electrically conductive material, such as a metal, and is kept at ground or close to ground potential, thereby keeping the liquid stream 26 at or close to ground potential. As the droplet stream 32 is formed at the droplet forming region 30, each droplet is charged inductively and the charged droplets are carried forward and out of the spray nozzle by a portion of the kinetic energy of the airstream 28. Because of the shown configuration of the invented nozzle, an air slipstream 40 forms around the droplet forming region 30 and the droplet stream 32 to keep the inner face of the electrode 34 i.e. the face facing the droplet forming region and the initial portion of the droplet stream 32, completely dry and smooth. This air slipstream 40 prevents any droplets from being deposited on the inner face of the electrode 34. Without the slipstream 40, it may be possible that droplets may be deposited on the electrode 34 and may peak up in the intense electric field just off the electrode, which may initiate a corona discharge and degrade the electrostatic induction charging process. Furthermore, the slipstream 40 continues to surround the droplet stream 32 as it travels through the nozzle passages 22 and 24 of the housing 12, thereby keeping the passages 22 and 24 dry and maintaining at a high level the surface resistance of the insulating material forming these passages.

The invented spray nozzle illustrated in FIG. 1 represents a specific experimental prototype drawn approximately to the scale, where some of the relevant dimensions, in inches, are as follows: the diameter of the passage 24 — 0.110; the diameter of the passage 22 — 0.140; the outside diameter of the induction electrode 34 — 0.625; the thickness of the electrode 34 — 0.050; and the combined length of the passages 22 and 24 — 0.265. Since the electrode 34 is spaced from the front face of the housing 12 (by a distance of 0.100 inches in the exemplary embodiment discussed above), and since the housing 12 is made of an electrically insulating material, the induction electrode 34 does not present an electrical hazard and is not susceptible to mechanical damage in use of the invented spray nozzle. Furthermore, since the high voltage source 36 is affixed to the housing 12, and the only high voltage lead 38 is embedded in the housing 12 and is completely enclosed in the high voltage source 36, there is little hazard from high voltage components of the source and little danger of mechanical damage to high voltage components. Since the air slipstream 40 keeps the passages 22 and 24 dry, there is little danger of leakage current.

Figure 2:
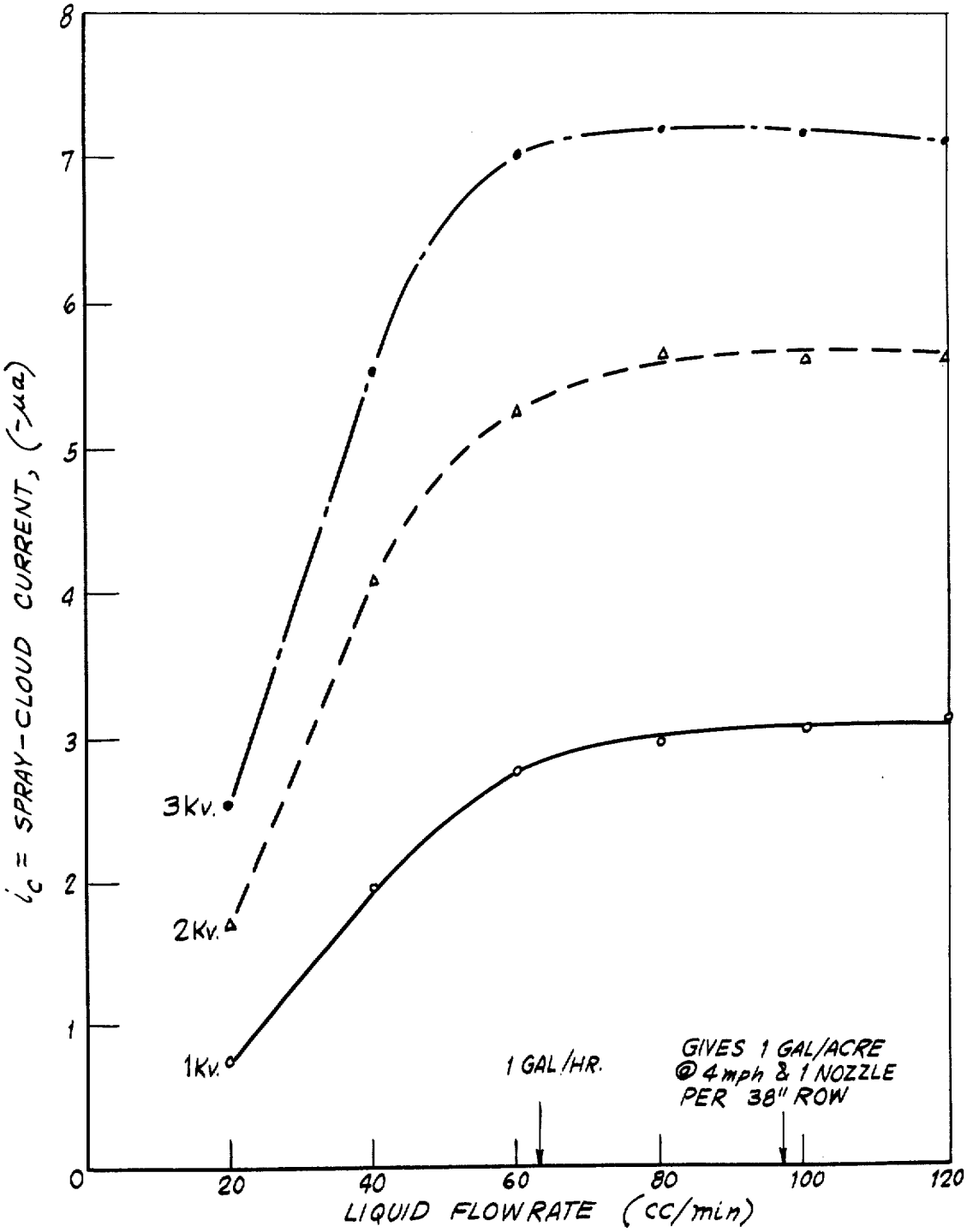
FIG. 2 is a diagram illustrating the relationship between liquid flow rate, charging voltage and spray-cloud current of the system shown in FIG. 1.

Experimental results with the invented nozzle illustrated in FIG. 1 show that it has a space-charge or spray-cloud current saturation characteristic with regard to the liquid flowrates such that above a certain minimum flow the spray-cloud current becomes nearly independent of liquid flowrate. In FIG. 2, which is an illustration of such experimental results, the horizontal axis represents liquid flowrate through the nozzle in units of cubic centimeters per minute, and the vertical axis represents spray-cloud current in microamperes. It is seen in FIG. 2 that the three curves, which are at potentials of the charging electrode 34 with respect to the liquid stream 26 of 1 kilovolt, 2 kilovolts and 3 kilovolts respectively, show that the spray-cloud current becomes substantially independent of flowrate for flowrates over about 1 gallon per hour. This characteristic of the invented spray nozzle provides some degree of self-regulation of the space charge imparted to spray clouds under the conditions of fixed charging voltage and liquid flowrate which varies either intentionally or unintentionally.

Figure 3:
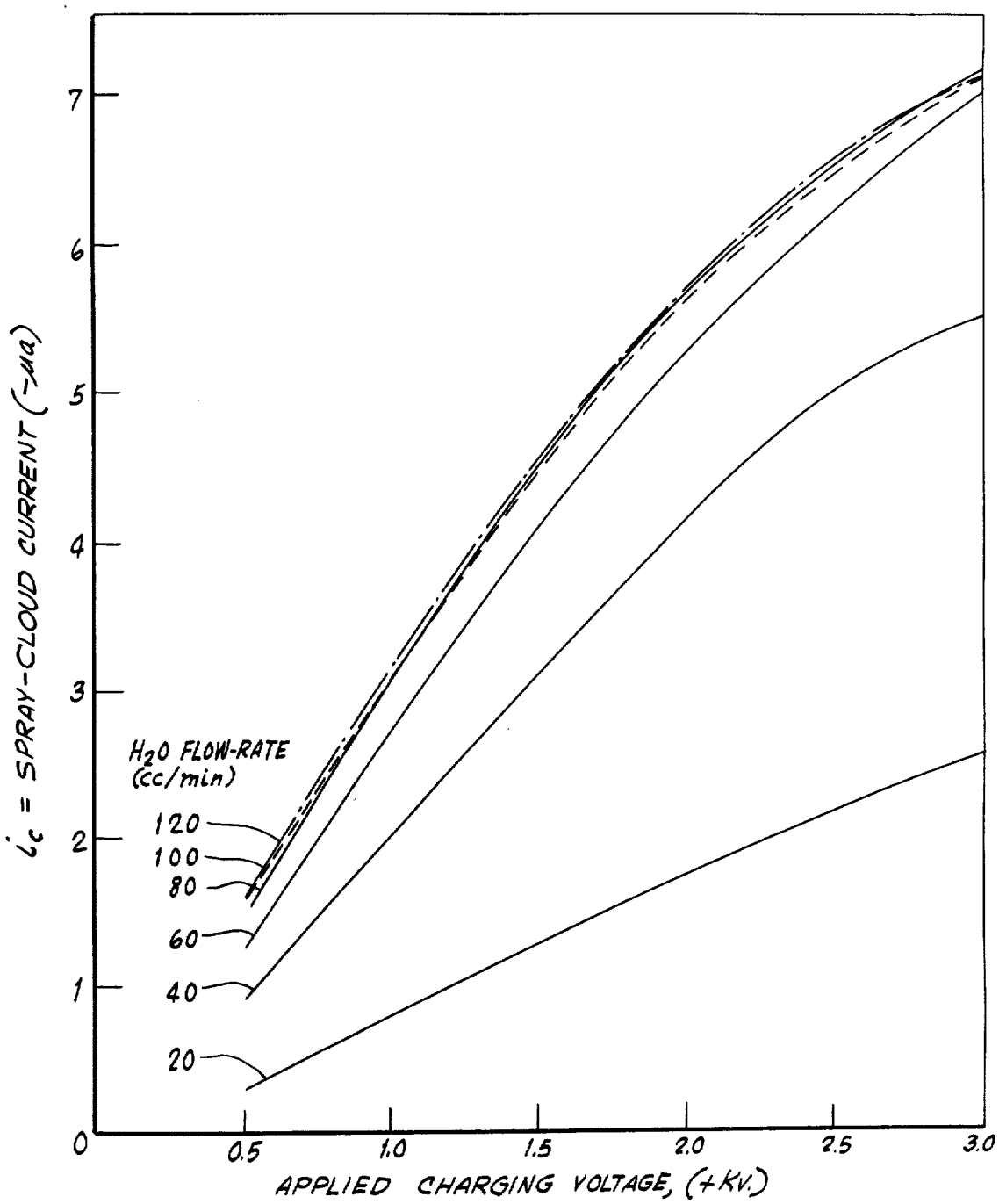
FIG. 3 is a different diagram illustrating the relationship between the charging voltage, the spray-cloud current and flow rate for the system shown in FIG. 1.

Additionally, experiments with the invented nozzle illustrated in FIG. 1 indicate that the spray-cloud current is nearly directly proportional to the voltage of the charging electrode 34 for typically used liquid flowrates. Referring to FIG. 3, the horizontal axis represents the voltage of the electrode 34 with respect to the liquid stream 26 in units of kilovolts, and the vertical axis represents the spray-cloud current in units of microamperes. It is seen in FIG. 3 that for each of the shown flowrates the spray-cloud current varies in nearly direct proportion with the voltage of the charging electrode 34 with respect to the liquid stream 26. It is noted that the maximum spray charging attained (7.2 microamperes at 80 cc/min. for water) represents about 15% of the theoretical Rayleigh charge limit for water if an average droplet diameter of 50 microns is assumed. It also represents a droplet charge at least three times greater than that which could typically be imparted to the droplets by the prior art ionized field charging techniques. Note that the data in FIG. 3 was limited by the use of a 0 – 3 KV power supply. When a higher output power supply is used, the results show spray charging up to about 11 microamperes at charging voltages of about +5 KV, with correspondingly higher percentage Rayleigh limiting charge. Moreover, when the droplet diameter is higher, the corresponding percentage Rayleigh limiting charge is higher; e.g. about 26% and 40% of the theoretical Rayleigh charge limit for 75 and 100 microns droplet diameter, respectively, each for about 80 cc/min. liquid flowrate and 7.2 microamperes cloud current at +3 KV.

Figure 4:
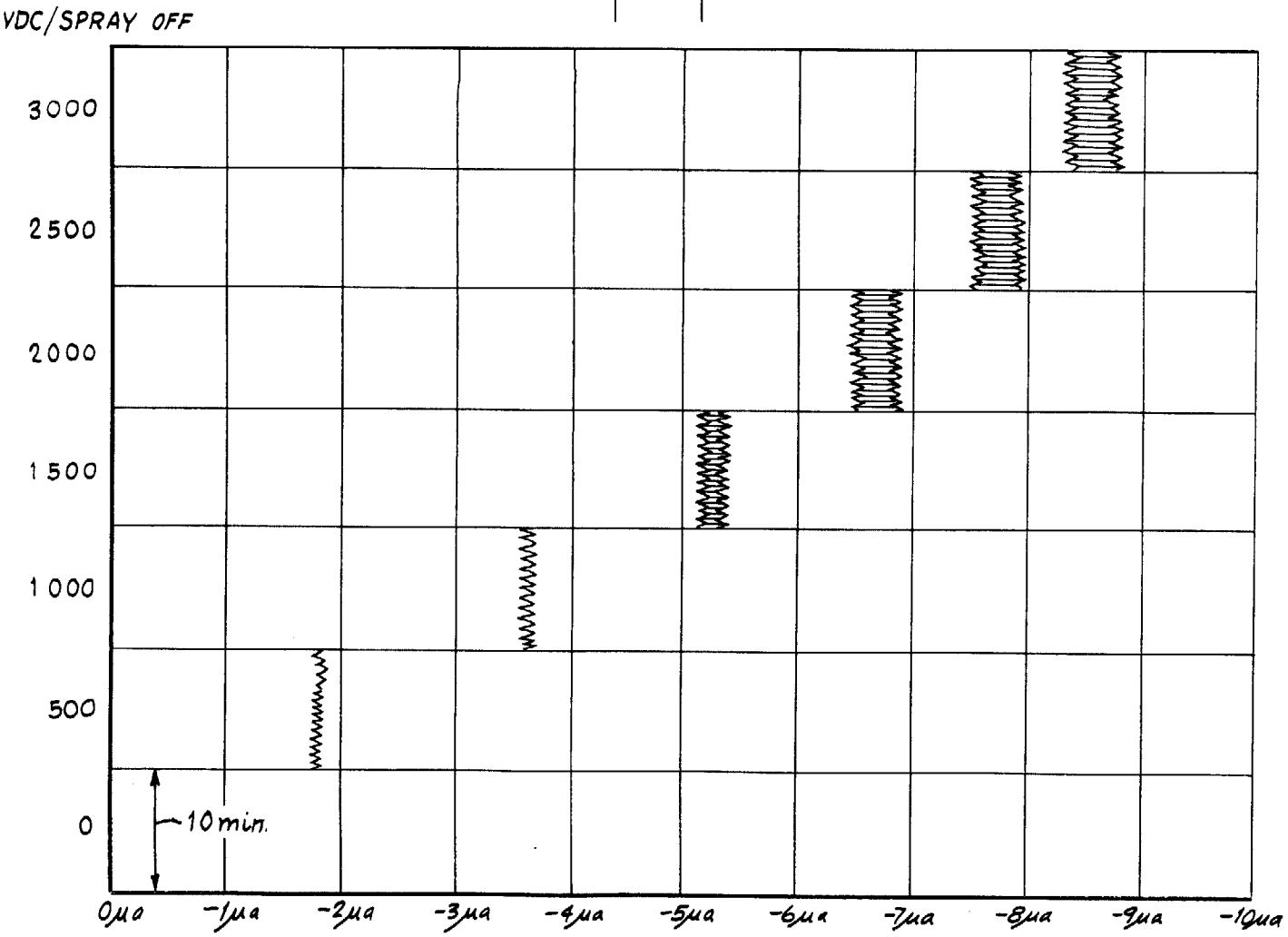
FIG. 4 is a diagram illustrating the spray charging stability of the system shown in FIG. 1.

Further tests with the invented nozzle illustrated in FIG. 1 indicate the long term spray-charging stability of the nozzle. Referring to FIG. 4, which illustrates a strip-chart recording of cloud current as a function of time for an eighty minute continuous test, charging voltage was increased in the 500 volts D.C. steps at each ten minute increment of elapsed time. Cloud current was found to hold constant to within better than ± 2% about its average value at each setting across this range. The slight negative cloud current during the first 10 minutes (at 0 volts) represents the typically small charge produced during droplet formation; the last 10 minutes (at 3000 volts with liquid flow off) verifies that negative air ions, possibly caused by ionization within the nozzle, were not being blown from the nozzle and were not being measured as a component of spray current (a spurt of sprayed water which had remained within the liquid inlet port to the spray nozzle after the liquid flow had been turned off caused the shown current spike). A number of similar long-term tests supported the result that the nozzle gave trouble-free spray charging, with no shorting, sparking or corona discharge detected.

It should be noted that a number of nozzles may be attached to the same rig to spray a wider area. Each nozzle may have an independent high-voltage supply, as discussed above, or a plurality of nozzles may share the same high-voltage supply, provided the environment is such that there is no significant electrical hazard from the high-voltage components connecting the nozzles to the shared high-voltage supply. The electrical space charge of the charged droplets can be varied by varying the charging voltage, as described above, or by varying other parameters, each as the size of the droplets, the resistivity of the liquid, the speed of the stream of droplets, and the like.

I claim:

1. An electrostatic spray nozzle comprising:

a housing made of an electrically insulating material and having a front end and a back end axially spaced from each other and means defining a hollow passage extending axially from the back end forwardly toward the front end of the housing;

an annular electrode made of an electrically conductive material and disposed within the housing, coaxially with and surrounding the hollow passage, said electrode having a front end spaced rearwardly of the front end of the housing by a selected distance along said passage; and means for forming a droplet stream moving axially forwardly through said passage from a droplet forming region disposed rearwardly of the front end of the electrode, said droplet stream forming means including a liquid conduit having a front end disposed axially rearwardly of the electrode and means for forming a liquid stream moving axially forwardly from said front end of the liquid conduit.

2. An electrostatic spray nozzle as in claim 1 including means for forming a gaseous slipstream moving along the surface of the electrode which faces the droplet stream and separating said electrode surface from the droplet stream.

3. An electrostatic spray nozzle as in claim 2 wherein said slipstream forming means include means for forming a gaseous slipstream moving through the portion of the passage between the electrode and the front end of the housing and separating the surface of said last recited passage portion from the droplet stream.

4. An electrostatic spray nozzle as in claim 1 including electrical means for maintaining the electrode at a selected potential with respect to the potential of the liquid stream, said electrical means comprising a low voltage input for receiving a low voltage input signal, an insulating housing which is affixed to the nozzle, means for converting the low voltage input signal to a high voltage output signal of a selected potential with respect to the liquid stream, said converting means being enclosed in said housing, and means enclosed in said housing for applying said high voltage electrical signal to the electrode.

5. An electrostatic spray nozzle as in claim 1 wherein the means for forming said droplet stream comprises pneumatic-atomizing means.

6. An electrostatic spray nozzle comprising:

an annular induction electrode made of an electrically conductive material and having a front end and a back end which are axially spaced from each other;

means for forming a liquid into a liquid jet originating at a region which is axially rearwardly of the electrode and extending axially forwardly from said region toward the electrode and means for converting the liquid of the jet into a stream of liquid droplets moving axially forwardly through the annular induction electrode and for forming a gaseous slipstream moving along the electrode surface facing the stream and separating the last recited surface from the jet and the stream;

means for maintaining the electrode at a selected electrical potential with respect to said liquid; and a hollow housing made of an electrically insulating material and surrounding the annular electrode, said housing having a front wall disposed forwardly of the front end of the electrode and means defining a spray orifice in said front wall which is substantially coaxial with the annular electrode.

7. An electrostatic spray nozzle as in claim 6 wherein the means for forming the droplet stream and the gaseous slipstream comprise a pneumatic-atomizing nozzle disposed within said housing at a location rearwardly of the front end of the annular induction electrode.

8. An electrostatic spray nozzle as in claim 7 including means for forming a gaseous slipstream moving along said spray orifice and separating the surface of said orifice facing the droplet stream from the droplet stream.

9. An electrostatic spray nozzle as in claim 8 wherein the means for maintaining the electrode at a selected potential comprise an insulating cover affixed to said housing and enclosing means for receiving a low voltage input signal, means for converting said low voltage input signal to a high voltage signal and means enclosed in said housing for applying said high voltage signal to the annular electrode.

10. An electrostatic spray nozzle comprising:

a base having an axially extending, central conduit for receiving liquid under pressure at its back end and for issuing a forwardly directed liquid stream at its front end, said base further having a separate, generally axially extending conduit for receiving air under pressure at its back end and for issuing at its front end a forwardly converging air stream for interacting with and atomizing said liquid stream;

a housing fixedly secured to the base and having an axially extending passage coaxial with the liquid conduit of the base, said passage having a back portion communicating with the air and liquid conduits to receive the streams issuing from the conduits and having a front portion extending forwardly of said back portion;

an annular induction electrode disposed within the housing, coaxially with the passage, said electrode having a front end which is rearwardly of the front portion of the passage but forwardly of the front ends of the conduits and a rear end which is forwardly of the front end of at least the liquid conduit;

the base and the back portion of the passage enclosing a droplet forming region where the air and the liquid streams interact to form a forwardly directed droplet stream combined with an air slipstream separating the electrode from the liquid and droplet streams and maintaining the electrode free of droplets and of liquid; and said housing being made of an electrically insulating material.

11. An electrostatics spray nozzle as in claim 10 including power supply means for maintaining said induction electrode at a selected electrical potential with respect to the liquid forming the liquid stream, said power supply means having low voltage components and high voltage components, and means for enclosing at least the high voltage components of the power supply means in an electrically insulating enclosure affixed to said housing at a location adjacent to the induction electrode.

12. A method of forming a stream of electrostatically charged liquid droplets comprising the steps of:

providing a liquid jet and converting the liquid jet into a stream of finely divided liquid droplets moving along a selected direction;

inductively charging the droplets of said droplet stream with a toroidal electrostatic field having lines of force emanating from an annular induction electrode and terminating at the droplet stream, said toroidal field being coaxial with said selected direction; and enclosing said induction electrode in an electrically insulating housing having an orifice coaxial with the selected direction for allowing the charged droplet stream to exit from the housing, said annular electrode and the toroidal electric field produced thereby being spaced inwardly into the housing from said orifice and said electrode being spaced forwardly of the origin of the liquid jet.

13. A method as in claim 12 wherein the step of converting the liquid jet into a droplet stream takes place at a droplet forming region located inside the housing and wherein the lines of force of said electrical field terminate at the droplet forming region.

14. A method as in claim 12 including the step of forming a gaseous slipstream moving along the surface of the induction electrode which faces the droplet stream and separating the last recited surface from the droplet stream.

* * * * *